United States Patent [19]

Gilmor et al.

[11] Patent Number: 4,938,651

[45] Date of Patent: Jul. 3, 1990

[54] GEAR LOCK QUICK DISCONNECT MECHANISM FOR ARTICULATED MACHINE

[75] Inventors: Jr. Gilmor, Ash Flat, Ak.; James J. Maynard, Marcellus, N.Y.

[73] Assignee: Gilmore Transportation Service, Inc., Sioux City, Iowa

[21] Appl. No.: 177,360

[22] Filed: Apr. 4, 1988

[51] Int. Cl.[5] ..... B66C 23/56

[52] U.S. Cl. ..... 414/694; 403/13; 403/339; 414/723

[58] Field of Search ..... 414/694, 729, 727, 685, 414/722, 723; 403/13, 14, 339

[56] References Cited

U.S. PATENT DOCUMENTS

| | | | |
|---|---|---|---|
| 2,831,544 | 4/1958 | Dunn et al. . | |
| 3,556,323 | 1/1971 | Heimmermann | 414/723 |
| 3,809,250 | 5/1974 | Pilch . | |
| 3,934,738 | 1/1976 | Arnold | 414/723 |
| 3,977,548 | 8/1976 | McCannon et al. . | |
| 3,985,249 | 10/1976 | Aker et al. . | |
| 4,208,163 | 6/1980 | Holmqvist . | |
| 4,214,840 | 7/1980 | Beales . | |
| 4,253,793 | 3/1981 | Braml . | |
| 4,353,945 | 10/1982 | Pilch . | |
| 4,571,146 | 2/1986 | Eriksson . | |
| 4,664,588 | 5/1987 | Newell et al. | 414/730 |
| 4,674,945 | 6/1987 | Hulden | 414/723 |
| 4,693,384 | 9/1987 | Gilmore, Jr. | 414/687 X |

OTHER PUBLICATIONS

American Coupler Systems, Inc. (brochure).
Balderson, Products for Catepillar Machines.
Wain-Roy Toolhitch Connector System-Nov., 1977.
Wain-Roy Quick Change Toolhitch Coupler System-May 1986.

*Primary Examiner*—David A. Bucci
*Assistant Examiner*—Donald W. Underwood
*Attorney, Agent, or Firm*—Lloyd L. Zickert

[57] ABSTRACT

An articulated arm type machine, such as an excavator, has a boom articulated for motion in a generally vertical arc, a stick articulated onto the distal end of the boom, and a tool mounted at the distal end of the stick. The stick is connected to the boom by a quick-disconnect shoe that is rockably mounted at the distal end of the boom and a mating fitting mounted at the proximal end of the stick. A pair of grab hooks on the shoe are used to pick up the stick fitting by hooking onto a grab pin mounted thereon. A set of gear tooth racks on the quick-disconnect shoe intermesh with a corresponding set of gear tooth racks on the stick fitting, and these eliminate play between the stick and boom.

25 Claims, 6 Drawing Sheets

40
110
112
114
108
112
104
50
106
110
104
120
124
126
102
84
120
122
116
118
86
100
82
96
94
104
92
86
90
80
76
90
88
92
78
82
72
68
66
72
70
64
64
64
36
58
66
74
68
51
60
62
70
60
62
58
98
54
56
52
30
54
38

GEAR LOCK QUICK DISCONNECT MECHANISM FOR ARTICULATED MACHINE

BACKGROUND OF THE INVENTION

This invention relates to articulated crane-type machines, such as hydraulic excavators, and is more particularly directed to machines of the type having a boom, a stick, and a tool attachment articulated with respect to one another, in which one or more sticks are interchangeably connectable to the boom.

A typical excavator or similar heavy equipment apparatus has an attachment arm formed of an articulate boom and a stick rockably mounted on the boom, with a bucket, blade, shear, grapple, fork, or other tool attached to the end of the stick. Hydraulic cylinders are mounted on the attachment arm to raise or lower the stick in the same plane. A tool cylinder connected between the tool and the stick operates the tool, i.e., raises or lowers the bucket, opens or closes the shear, etc.

Different tools are often required for an operation. If these are to be joined to the same excavator or other similar apparatus, it is required to remove the tool from the stick, or to remove the stick from the boom to substitute a different tool or stick. The stick is taken off the boom to substitute a different stick, for example, a stick of a different length or width, or a stick having a different tool formed unitarily on it. A pivot pin is driven from the articulated joint between the distal end of the boom and the stick, and an eye pin is driven from the connection of the stick with the stick cylinder rod. Then the substitute stick has to be manipulated, the pivot pin driven back into place, and the eye pin driven into place. After that, hydraulic lines have to be run from the excavator body to the tool cylinder. Aligning the stick with the boom is difficult. This operation can require the work of a crew of several skilled workmen and can consume an hour or more.

Quick-disconnect mechanisms have been well known for the tool end of the stick, for example, to facilitate the interchange of buckets of different sizes or configurations. This has been especially proposed with respect to backhoe attachments in the field. However, no such satisfactory quick-disconnect mechanism has been known for use between the stick and the boom.

It is often required to use attachments with integral stick and tool configurations, for example, a large shears employed for the recycling of steel scrap. It is well accepted now that one-piece shear-stick arrangements are far superior to a combination of a stick and an interchangeable or pin-on shear. This is so, at least in part, because of the structural soundness of the shear-stick and the relatively low installation and removal time requirements of an integral shear-stick. In a steel scrapping operation, it is often necessary to change from a shear to a grapple, clamshell, or other attachment quickly and without a crew in attendance. However, this cannot be done unless there are some means provided for the quick connecting and disconnecting of the stick to the boom of the excavator machine employed for that purpose.

If quick disconnect mechanism presently used on wheel loaders between the loader arms and buckets were used between the boom and the stick, the stick may tend to wobble somewhat because of play in the mechanism amplified over the length of the stick.

OBJECTS AND SUMMARY OF THE INVENTION

Accordingly, it is an object of this invention to provide an articulated crane-like machine which avoids the drawbacks of the prior art, and which permits the quick interchangeability of various stick configurations onto a boom of the machine.

It is another object of this invention to provide a machine with a suitable quick-disconnect mechanism wherein the sticks can be interchanged with a minimum crew size, without need to manipulate the sticks to effect the connecting or disconnecting, and which gives a secure stable mounting.

In accordance with an aspect of this invention, an articulated crane-type machine, such as a hydraulic excavator, has a base, an overcarriage swingably mounted on the base and including a drive for swinging the overcarriage in a generally horizontal plane, a boom having its proximal end pivotally mounted on the overcarriage for motion in a generally vertical arc, a boom cylinder or equivalent means for raising and lowering the boom in its arc, a stick having its proximal end rockably mounted at the distal end of the boom, with a tool being mounted at the distal end of the stick, and with a stick cylinder or other equivalent means for rocking the stick relative to the boom. At the distal end of the boom there is an articulated quick-disconnect shoe, and mating structure is affixed on the proximal end of the stick for permitting the stick to be removably joined to the quick-disconnect shoe.

In a favorable embodiment, the mating structure has a transverse grab pin and male aligner member, while the quick-disconnect shoe includes a grab hook disposed at one side of the shoe and opening towards that one side of the shoe for engaging the grab pin, with the hook being rotatable on the grab pin. The quick-disconnect shoe also has a pair of female aligner members disposed laterally opposite each other for receiving the male aligner member to align them into mating engagement. When the quick-disconnect plate and the mating mechanisms have been aligned by the male and female aligners, a pair of transverse pairs on the shoe engage mating recesses in the mating structure, and draw the mating structure into engagement with the shoe. The grab pin slides on the grab hook. An arrangement of gear-tooth rocks on the shoe and on the mating structure to engage one another and prevent lateral play or wobble.

The improvement of this invention is especially useful when the stick takes the form of a unitary stick-shear arrangement, with its tool being a hydraulic shear having a jaw unitarily formed at the distal end of the stick.

The foregoing and many other objects, features and advantages of this invention will be more fully understood from the ensuing detailed description of a preferred embodiment, when considered in connection with the accompanying drawing.

DETAILED DESCRIPTION OF THE PREFERRED EMBODIMENT

Figures 1, 5:
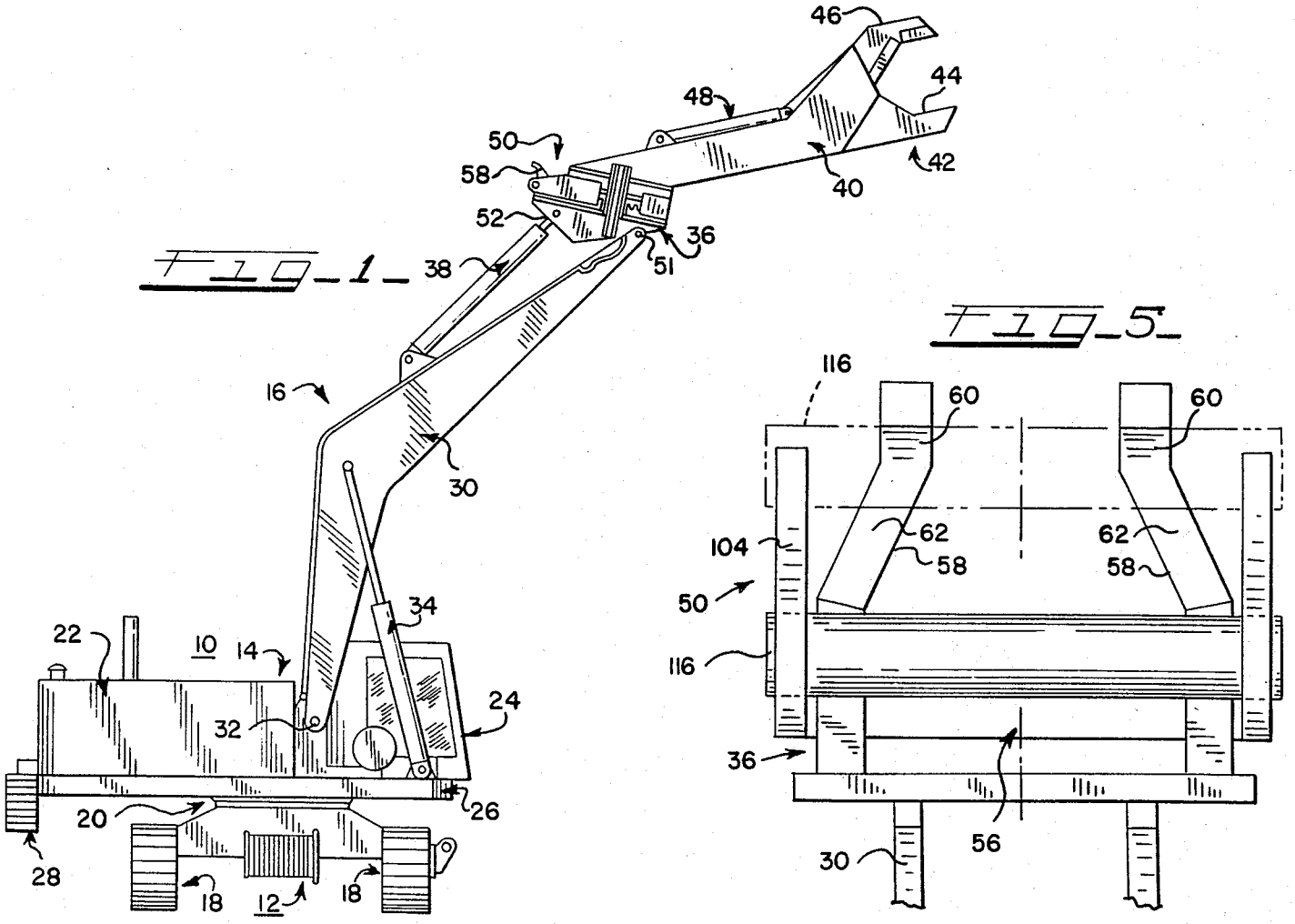
FIG. 1 is an elevational view of an articulated crane-type machine according to one embodiment of this invention.
FIG. 5 is a sectional view taken at line 5—5 of FIG. 3.

With reference to the drawing, and initially to FIG. 1 thereof, a crane-type excavator machine 10 is shown to have an undercarriage 12, an overcarriage 14, and a front attachment 16. The undercarriage 12 consists basically of track and roller assemblies 18 and a carbody and swing bearing assembly 20. The overcarriage 14 of the excavator machine 10 has an engine compartment 22 which contains the prime mover engine for the machine and also contains the hydraulic system, an operator's cab 24, a platform 26, which is mounted for swingable action on the carbody and swing bearing 20, and a counterpoise 28 at the side remote from the cab 24.

The front attachment 16 of the machine 10 is formed of a dogleg boom 30 whose proximal end is mounted by means of a pivot pin 32 to the overcarriage 14. A boom cylinder 34 has a cylinder end mounted to the platform 26 and has its rod end connected to the arch of the boom 30. A quick-disconnect shoe 36, discussed in greater detail later, is rockably mounted at the distal end of the boom 30, and a stick cylinder 38 has a cylinder end mounted on the boom 30 and a cylinder rod coupled to a point on the quick-disconnect shoe 36 spaced from the mounting on the distal end of the boom 30.

A stick 40, here in the form of a stick shear, has its proximal end removably mounted on the quick-disconnect shoe 36, and has a shear 42 unitarily formed on its distal end. The shear 42 has a fixed jaw 44 unitarily formed with the stick 40, and has a movable jaw 46 pivotally mounted on the stick 40 to open and close to the fixed jaw 44, and which is rocked by a shear cylinder 48.

Hydraulic lines, not shown in great detail here, extend from the overcarriage 14 to the cylinders 34, 38, and 48 to effect the extension and retraction of the cylinders. These lines are fitted with quick-disconnect fittings of any conventional type.

Figure 2:
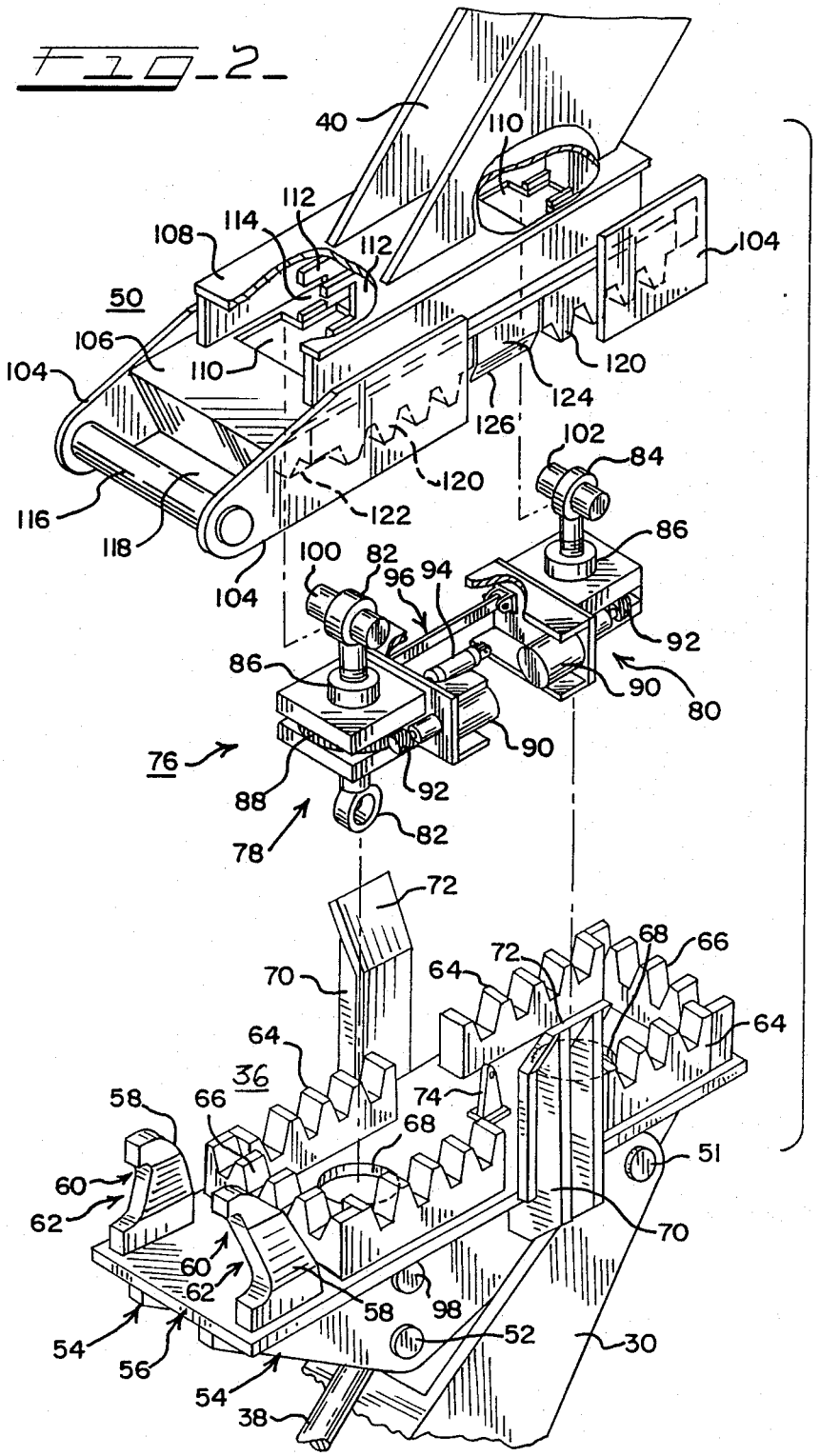
FIG. 2 is a perspective, partly exploded view of the quick-disconnect mechanism of the embodiment of FIG. 1.
Figure 3:
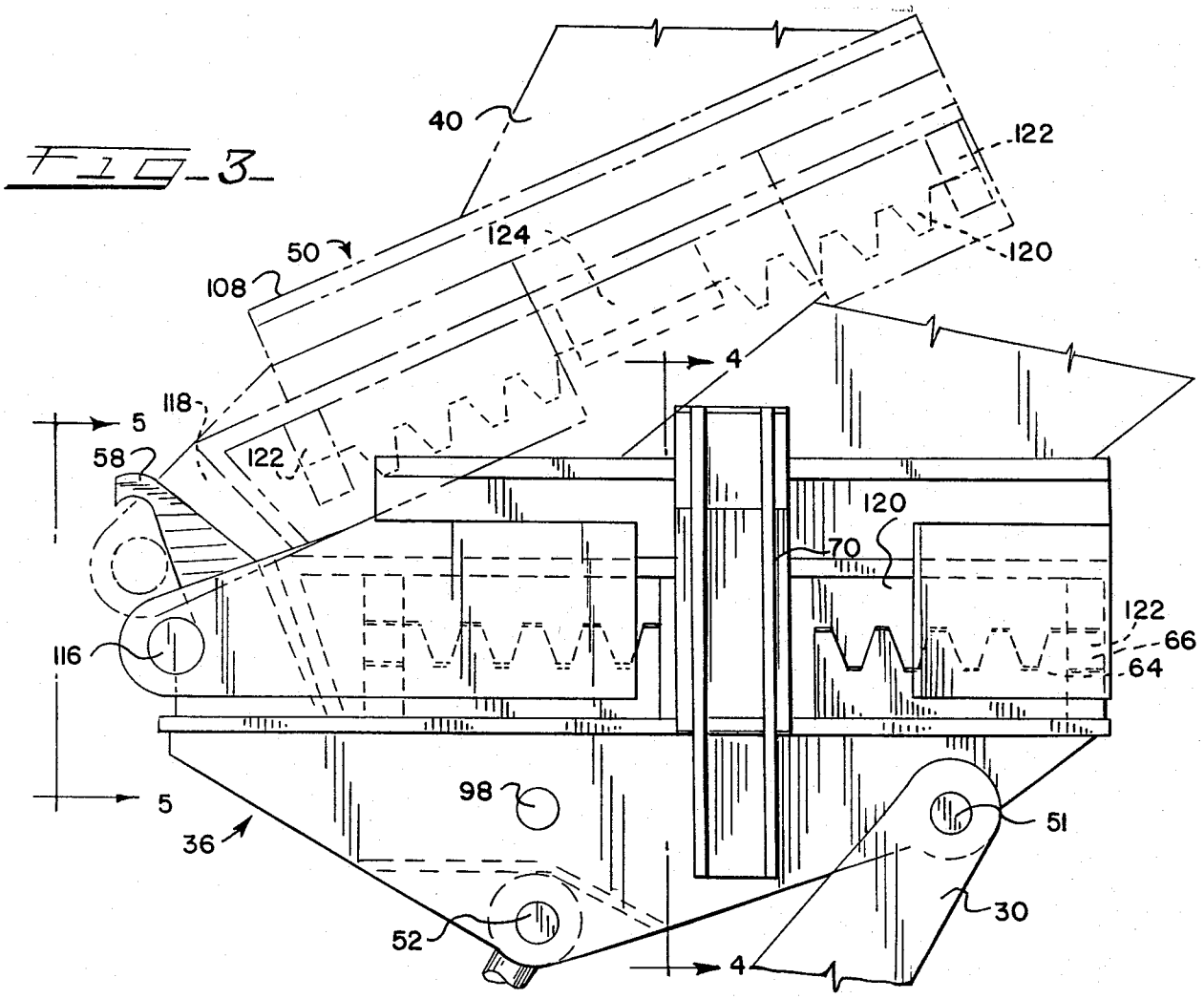
FIG. 3 is an elevational sectional view of the quick-disconnect mechanism of FIG. 1.

A fitting 50 on the proximal end of the stick 40 permits the stick 40 to be quickly installed on or removed from the boom. As shown in FIGS. 2 and 3, the quick-disconnect shoe 36 is mounted by a pivot pin 51 to the distal end of the boom 30. The pivot pin 51 mates with a bore at the end of the boom 30, and is rotatably journalled in the shoe 36. An eye pin 52 extends through an eye on the rod of the stick cylinder 38, and is also journalled in the shoe 36. The quick-disconnect shoe 36 is formed of a pair of side wall plates 54 penetrated by the pins 51 and 52, and a main plate 56 affixed transversely thereto. A pair of grab hooks 58 are attached on the distal face of the plate 56 and towards the edge nearest which the stick cylinder 38 is connected. These grab hooks extend distally, and each has a curved hook surface 60 and a slanting slide surface 62 that extends proximally from the surface 60. The grab hooks 58 slope towards each other, as shown in FIG. 5 for more clearance at their distal ends to grip the fitting 50. A set of gear-tooth racks 64 are affixed onto the distal side of the main plate 56 and extend longitudinally across it, while a set of gear tooth racks 66 extend transversely thereacross. Each rack includes a plurality of teeth extending generally vertically from the base or main plate 56 such that they extend toward each other as the coupling members 36 and 50 come together. The teeth are provided with slanting flat surfaces wherein slanting surfaces of the teeth on one member mate with slanting surfaces of teeth on the other member. Some of the slanting surfaces slant in one direction while other of said surfaces slant in another direction relative to the vertical. Moreover, since racks 66 are at right angles to racks 64, some of the slanting surfaces of some teeth are angularly turned relative to each other of the slanting surfaces of other teeth. The slanting surfaces of teeth on racks 64 are turned at right angles to the slanting surfaces of teeth on racks 66. Thus, the teeth on coupling member 36 are of like shape to the teeth on coupling member 50. In this embodiment, the rack 64 and 66 form a quadrilateral, although other arrangements are possible within the scope of this invention.

There are clearance holes 68 in the plate 56 for accommodating a lock assembly to be described later.

A pair of female aligners 70 extend distally from opposite sides of the shoe 36, and are situated about halfway from the end thereof where the grab hooks 58 are located. A cylinder mount 74 is affixed onto the plate 56 between the two clearance holes 68.

A lock assembly 76 fits onto the shoe 36 and includes a front frame half 78 and a rear frame half 80. A pair of draw bolts 82 and 84 are respectively situated through the frames 78, 80, and are formed of top and bottom halves that are oppositely threaded. Respective elongated threaded nuts 86 are rotatably mounted in each of the frame halves 78, 80, and each has a rotatable worm gear 88 affixed onto its outer surface. Worm gear motors 90 are mounted on each of the frame halves 78, 80 and each drives a worm gear pinion 92 on its output shaft, the pinion 92 rotating the associated gear 88.

A lock mechanism cylinder 94 has one end attached to the front frame half 78, and another end attached to the cylinder mount 74, while a link 96 is articulated onto the two frame halves 78, 80. The front frame half bolt 82 has an eye that is journalled onto a pin 98 that extends through the shoe wall plates 54, while the other bolt 84 has a corresponding eye journalled onto the eye pin 51. The bolts 82 and 84 extend through the respective clearance holes 68. A pair of transverse pins 100 and 102 are affixed through upper eyes of the two bolt assemblies 82 and 84, and serve to engage mating structure in the stick fitting 50. Hydraulic connections to the motors 90 and the cylinder 94 have been omitted for the sake of avoiding drawing clutter, but their connections would be apparent to those of skill in the art.

The stick fitting 50 has a pair of elongated side plates 104 with a main plate 106 extending between them. A transverse web 108 extends between the side plates 104 above the main plate 106, and attaches to the main portion of the stick 40.

Figure 4:
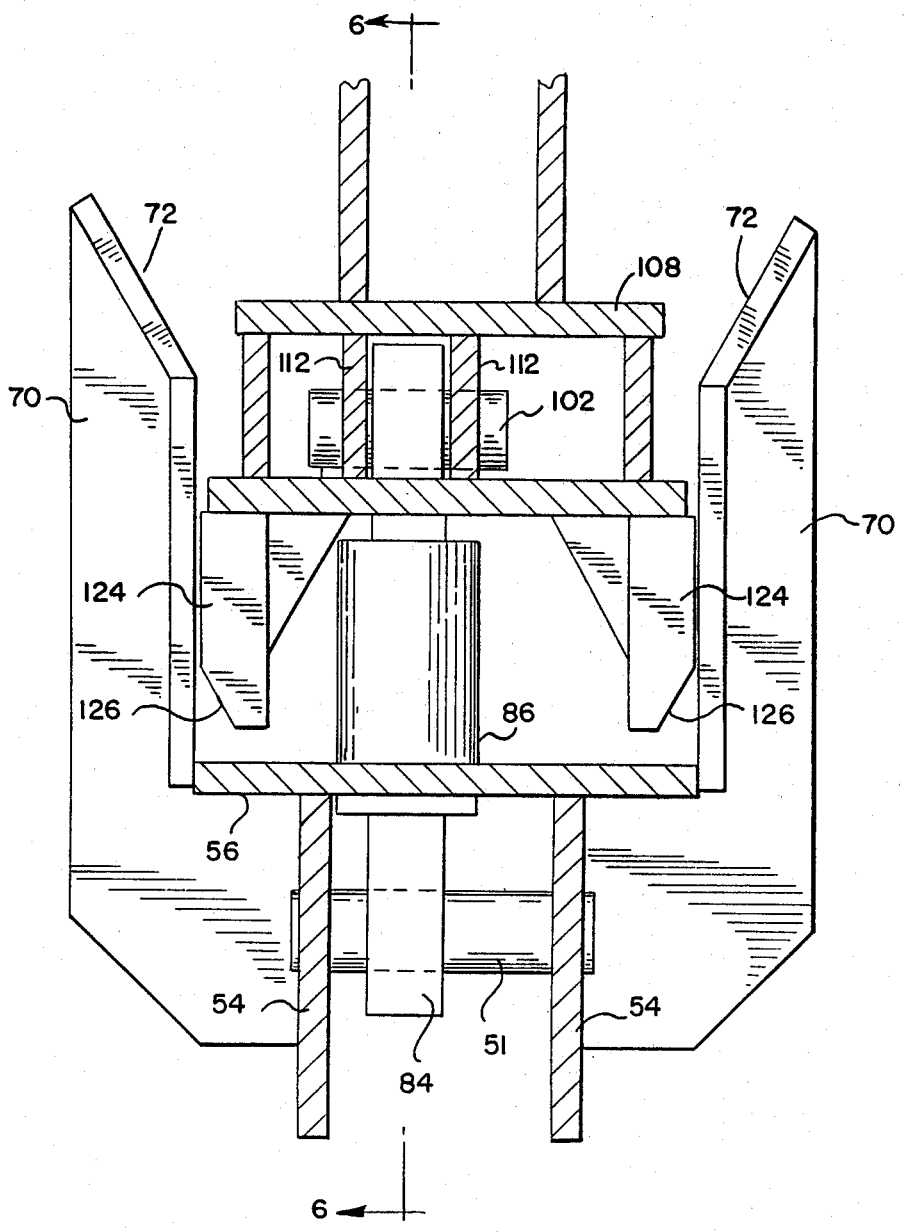
FIG. 4 is a sectional view taken at line 4—4 of FIG. 3.

A pair of T-shaped clearance holes 110 are provided to permit insertion of the pins 100, 102 of the lock assembly 76. There are a pair of parallel flanges 112 affixed to the plate 106 and web 108. As shown in FIG. 4, one of these flanges 112 can be at or near the stick center line and the other offset to one side of the stick 40. This means that the bolt assemblies 82, 84 have center lines offset from the stick center line.

Figure 6:
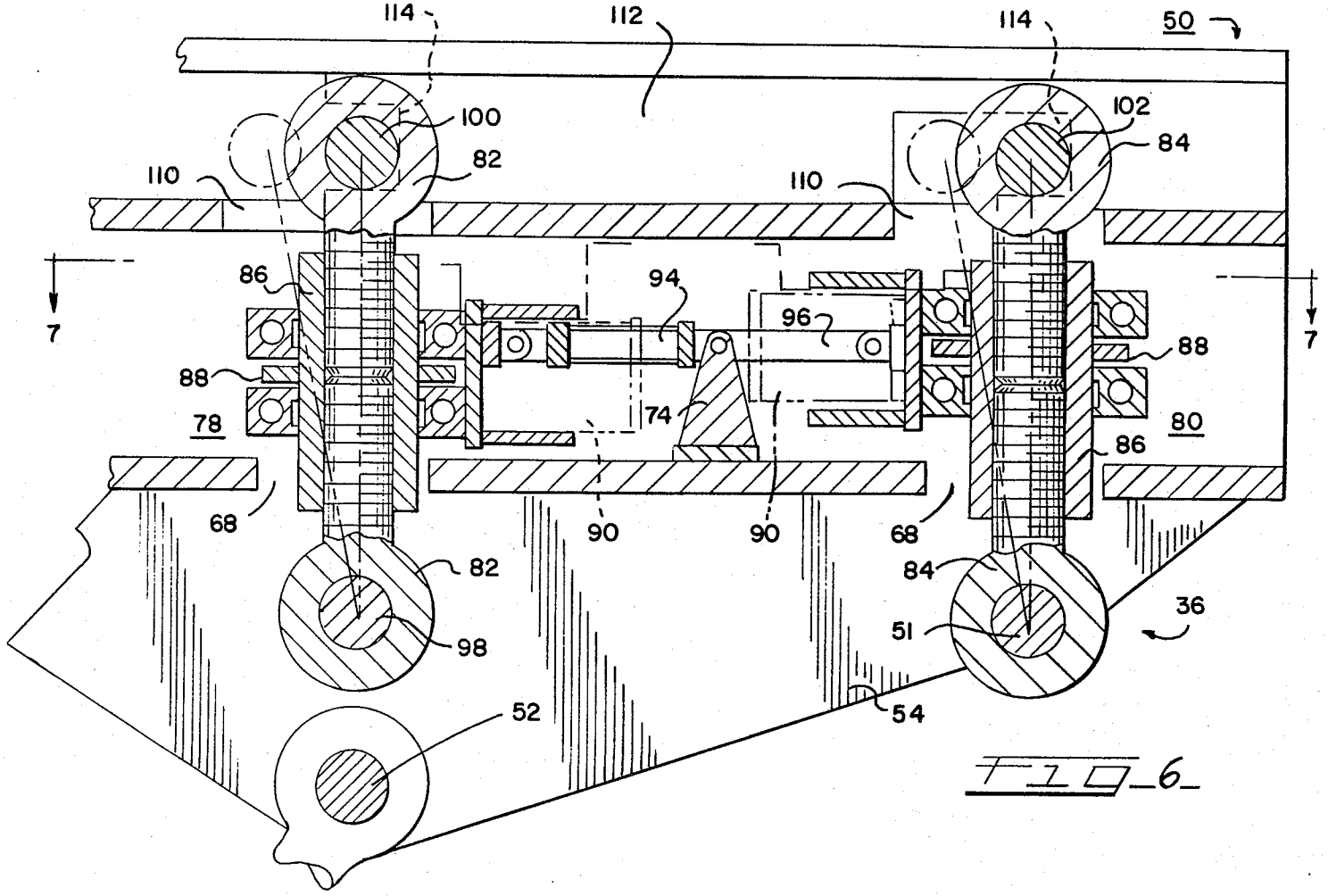
FIG. 6 is a sectional view taken along lines 6—6 of FIGS. 4 and 7.
Figure 7:
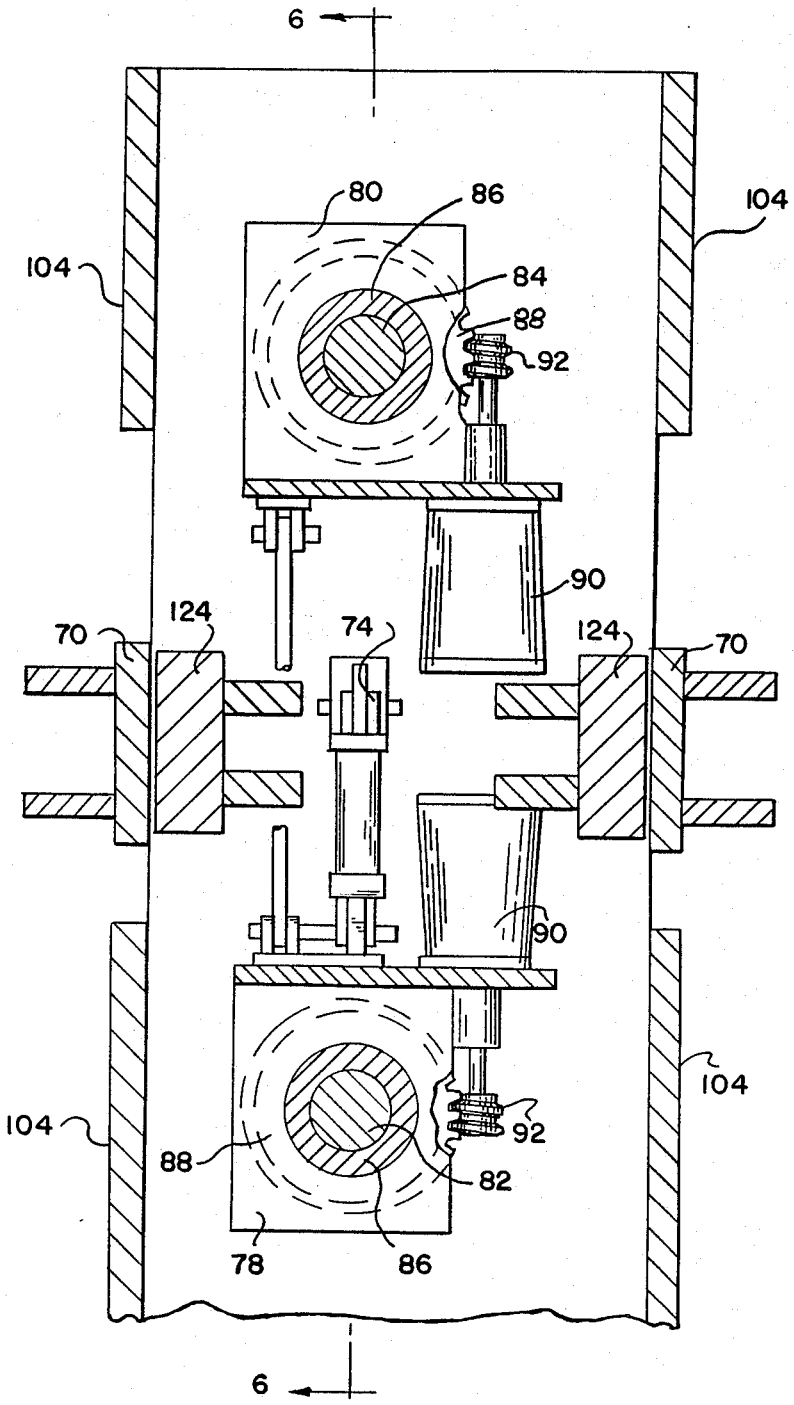
FIG. 7 is a sectional view of a portion of the quick-disconnect mechanism, taken along line 7—7 of FIG. 6.

There are a pair of longitudinal cutouts 114 in the flanges 112 to receive the pins 100, 102. Details of this are also shown in FIG. 6.

As shown in FIGS. 2 and 3, one end of each of the side plates 104 extends beyond a forward edge of the main plate 106, and a grab pin 116 is mounted between ends of the side plates 104. A clearance 118 is defined behind the grab pin 116. The grab hooks 58 of the shoe 36 fit into this clearance 118, and the grab pin 116 is received onto the hook surface 60 as indicated in ghost lines in FIG. 5.

Longitudinal gear tooth racks 120 and transverse gear tooth racks 122 are situated on the proximal surface of the main plate 106 and these mesh with the gear tooth racks 64 and 66 of the shoe 36, as indicated in solid lines on FIG. 3. As also indicated on FIGS. 2 and 3, the longitudinal racks 120 are split into front and rear halves, and a male aligner guide member 124 is affixed on each side of the plate 106 between the two halves of the associated rack 120. The aligner members 124 have beveled proximal faces 126. This means that the male members 124 are situated opposite one another on the fitting 50 between the positions of the associated female aligners 70. This is shown in FIG. 4.

The quick-connect/disconnect mechanism of this invention can be explained as follows, and with reference, e.g., to FIGS. 3, 5, and 6.

When the operator desires to connect a stick onto the boom 30, the operator manipulates the boom and quick-disconnect shoe 36, by means of the cylinders 34 and 38, to position the grab hook 58 between the fitting side plates 104 and under the grab pin 116. The grab hooks 58 are closer together at their free ends, as shown in FIG. 5, to permit insertion when there is not good alignment. The operator can then rock the boom 30 upwards, and the grab pin comes in contact with the rounded hook surface 60. Then, as the boom is lifted, the stick 40 and the associated fitting 50 swing into contact with the shoe 36. Here, the beveled surfaces 126 of the male aligner guide blocks 124 meet the beveled surfaces 72 of the female aligners 70. As the stick 40 and fitting 50 continue to swing downward, these aligning members 70 and 124 will straighten out the stick 40 and fitting 50 so that the teeth of the racks 64, 66 and 120, 122 can enter into intermeshing engagement. Thus, this structure permits unassisted operator hookup, even when the attachment and stick are not facing each other squarely, or are not located on level ground.

Once the grab hooks 58 and grab pin 116 and the male and female aligners 124, 70 have brought the stick fitting 50 into general alignment with the shoe 36, the lock assembly 76 engages the fitting 50 in the cutouts 114 and pulls the fitting 50 into secure engagement as shown in FIG. 3, with the teeth of the racks 64, 66 intermeshed with the teeth of the fitting racks 120, 122.

When the fitting 50 and the shoe 36 are more or less aligned, the grab pin 116 slides proximally from the curved hook surfaces 60 of the grab hooks 58 along the slanting side surfaces 62, thereby permitting the gear teeth to snap into engagement. At that point, the pins 100, 102 are in the position shown in chain in FIG. 6, i.e., with the distal eye of the bolts 82, 84 extending through the T-shaped clearance holes 110. The operator in the cab 24 can then actuate a lever to move the cylinder 94, and thereby swing the lock assembly mechanism 76 to the solid-line position of FIG. 6, with the pins 100, 102 engaging the transverse cutouts 114. The operator then actuates another lever and supplies hydraulic or electric power to the motors 90. This rotates the worm gears 88 and elongated threaded nuts 86, thereby drawing the bolt assemblies 82, 84 in the proximal direction, to lock the stick fitting 50 securely to the quick-disconnect shoe 36.

The above procedure is done in reverse order to remove the stick 40 from the boom 30.

It should be appreciated that the gear-type teeth of the racks 64, 66 on the shoe 36 and of the racks 120, 122 of the stick fitting 50 prevent either vertical or horizontal movement as between the shoe 36 and the mating fitting 50. This eliminates all slop or play, thus eliminating any undesired wobble in the positioning of the stick 40. The gear-lock arrangement increases the reliability and positioning of the tool that is connected to the stick, usually at some distance from the shoe 36 and fitting 50, thereby promoting reliability and precision in most industrial equipment functions, such as digging, excavating, shearing, lifting, etc.

A worm gear modulating valve (not shown) can be located in the cab 24. This valve prevents overtightening and thus eliminates the possibility of stripping the threads on the bolts 82, 84 or nuts 86. The modulating valve also allows the worm gear motors 90, pinions 92, and worm gears 88 to maintain constant tension on the bolts 82, 84, so that the fitting 50 is held snug against the shoe 36.

The present invention has application not only to the excavator type machine illustrated in FIG. 1, but also to other machines, which can be either track or rubber tire, such as wheel loaders, rack loaders, motor graders, loader back hoes, skid-steer loaders, and agricultural or industrial equipment of the type that has a boom and stick, or has linkage or arms that can be adapted to operate like a boom and stick. Of course, the stick 40 can have any desired tool attached to it, such as a bucket, clam shell, stinger, dozer, impact hammer, tamper, or other tool.

While the invention has been described in detail with respect to a single embodiment, it should be understood that the invention is not limited to that embodiment. Rather, many modifications and variations would be apparent to those of skill in the art without departing from the scope and spirit of this invention, as defined in the appended claims.

What is claimed is:

1. In an articulated crane-type machine comprising a base, an overcarriage swingably mounted on said base and including means for swinging said overcarriage in a generally horizontal plane, a boom having a proximal end and a distal end, the proximal end being pivotally mounted on said overcarriage for motion in a generally vertical arc, means for raising and lowering said boom in said arc, a stick member at the distal end of said boom including quick-disconnect means for removably mounting the proximal end of said stick member onto said boom and permitting rocking movement of said stick member relative to said boom, a tool mounted at a distal end of said stick member, and means for rocking the stick member relative to said boom; the improvement wherein said quick-disconnect means comprises a shoe articulated on the distal end of said boom and a mating member affixed on the proximal end of said stick member removably coupling to said shoe, said shoe and mating member each comprising respective mating gear rack members which mesh together when said shoe and mating member are coupled together and prevent lateral play between the stick member and the boom, wherein said rack members include at least one gear tooth rack extending horizontally on each of said shoe and said mating member.

2. The machine of claim 1 wherein said racks are disposed substantially at an outer perimeter of each of said shoe and said mating member.

3. In an articulated crane-type machine comprising a base, an overcarriage swingably mounted on said base and including means for swinging said overcarriage in a generally horizontal plane, a boom having a proximal end and a distal end, the proximal end being pivotally mounted on said overcarriage for motion in a generally vertical arc, means for raising and lowering said boom in said arc, a stick member at the distal end of said boom including quick-disconnect means for removably mounting the proximal end of said stick member onto said boom and permitting rocking movement of said stick member relative to said boom, a tool mounted at a distal end of said stick member, and means for rocking the stick member relative to said boom; the improvement wherein said quick-disconnect means comprises a shoe articulated on the distal end of said boom and a mating member affixed on the proximal end of said stick member removably coupling to said shoe, said shoe and mating member each comprising respective mating gear rack members which mesh together when said shoe and mating member are coupled together and prevent lateral play between the stick member and the boom, wherein said shoe includes a pair of female aligner members laterally opposite one another and extending distally, and said mating member comprises a pair of male aligner members laterally opposite one another and facing proximally to be received within said female aligner members for aligning the mating member onto said shoe when the associated stick member is being connected to said boom.

4. The machine of claim 3 wherein said male and female aligner members have beveled proximal and distal faces, respectively to facilitate aligning the mating member onto said shoe.

5. In an articulated crane-type machine comprising a base, an overcarriage swingably mounted on said base and including means for swinging said overcarriage in a generally horizontal plane, a boom having a proximal end and a distal end, the proximal end being pivotally mounted on said overcarriage for motion in a generally vertical arc, means for raising and lowering said boom in said arc, a stick member at the distal end of said boom including quick-disconnect means for removably mounting the proximal end of said stick member onto said boom and permitting rocking movement of said stick member relative to said boom, a tool mounted at a distal end of said stick member, and means for rocking the stick member relative to said boom; the improvement wherein said quick-disconnect means comprises a shoe articulated on the distal end of said boom and a mating member affixed on the proximal end of said stick member removably coupling to said shoe, said shoe and mating member each comprising respective mating gear rack members which mesh together when said shoe and mating member are coupled together and prevent lateral play between the stick member and the boom, wherein said shoe includes at least one grab hook extending distally from one end thereof, and said mating member includes a lateral grab pin fitting in said hook, said hook and pin achieving initial swinging of said mating member into alignment with said shoe and then proximal sliding of the mating member to enmesh the at least one gear rack member of the shoe, and said shoe further includes a locking member for engaging the mating member and pulling the same into engagement with said shoe.

6. In an articulated crane-type machine comprising a base, an overcarriage swingably mounted on said base and including means for swinging said overcarriage in a generally horizontal plane, a boom having a proximal end and a distal end, the proximal end being pivotally mounted on said overcarriage for motion in a generally vertical arc, means for raising and lowering said boom in said arc, a stick member at the distal end of said boom including quick-disconnect means for removably mounting the proximal end of said stick member onto said boom and permitting rocking movement of said stick member relative to said boom, a tool mounted at a distal end of said stick member, and means for rocking the stick member relative to said boom; the improvement wherein said quick-disconnect means comprises a shoe articulated on the distal end of said boom and a mating member affixed on the proximal end of said stick removably coupling to said shoe, said shoe and mating member each comprising respective mating gear rack members which mesh together when said shoe and mating member are coupled together and prevent lateral play between the stick member and the boom, wherein said shoe includes at least one threaded shaft having an engaging member at one end for engaging a cooperating structure in said mating member, a nut engaging said threaded shaft for rotating the same relative to said threaded shaft and drawing said mating member into engagement with the shoe, and motor means for rotating said nut.

7. The machine of claim 6 wherein said motor means includes a hydraulic rotary motor having an output shaft, a worm gear pinion mounted on said output shaft, and a worm gear engaging said pinion and coaxially mounted on said nut.

8. The machine of claim 7 further comprising hydraulically powered means for moving said hydraulic motor means and said threaded shaft laterally relative to said shoe to engage and disengage said cooperating structure on said mating member.

9. In an articulated heavy construction machine of the type comprising a base, a boom having a proximal end and a distal end, the proximal end being pivotally mounted on said base for motion in a generally vertical arc, means for raising and lowering said boom in said arc, a stick member at the distal end of said boom including quick-disconnect means for removably mounting the proximal end of said stick member onto said boom and permitting rock movement of said stick member relative to said boom, a tool mounted at a distal end of said stick member, and means for rocking the stick member relative to said boom: the improvement wherein said quick-disconnect means comprises a shoe articulated on the distal end of said boom and a mating member affixed on the proximal end of said stick member removably coupling to said shoe, said shoe and said mating member including respective intermeshing gear rack members affixed thereon, which mesh together when the shoe and mating member are coupled together and prevent lateral play between the stick member and the boom, wherein said rack members each include at least one gear tooth rack extending in on direction and at least one gear tooth rack extending in a direction transverse to said one direction.

10. In an articulated heavy construction machine of the type comprising a base, a boom having a proximal end and a distal end, the proximal end being pivotally mounted on said base for motion in a generally vertical arc, means for raising and lowering said boom in said arc, a stick member at the distal end of said boom including quick-disconnect means for removably mounting the proximal end of said stick member onto said boom and permitting rocking movement of said stick member relative to said boom, a tool mounted at a distal end of said stick member, and means for rocking the stick member relative to said boom: the improvement wherein said quick-disconnect means comprises a shoe articulated on the distal end of said boom and a mating member affixed on the proximal end of said stick removably coupling to said shoe, said shoe and said mating member including respective intermeshing gear rack members affixed thereon, which mesh together when the shoe and mating member are coupled together and prevent lateral play between the stick member and the boom, wherein said shoe comprises a pair of female aligner members opposite one another and extending distally therefrom, the female aligner members being spaced apart to define a span therebetween and said mating member has a pair of male guide members laterally opposite one another and spaced to fit within the span of said female aligner members and facing proximally.

11. In a machine adapted for heavy work including a boom, a stick having a tool for performing heavy work, means for driving the boom and stick, and a quick disconnect coupling between the boom and stick to permit quick interchanging of sticks, the improvement in the coupling which comprises a male member attached to one of the boom or stick and a female member attached to the other of the boom or stick, said female member comprising a base, grab hook means on one end, aligning means intermediate the ends of the base for guiding alignment of the female member, intermeshing elements on said female member adapted to tightly interfit with elements of like shape on said male member, said elements extending generally vertically from the base and toward each other as the members come together and being arranged to inhibit both longitudinal and transverse movement between the male and female members, said elements further including a plurality of slanting flat surfaces, the slanting surfaces of elements on one member mating with slanting surfaces of elements on the other member, some of said slanting surfaces slanting in one direction from the vertical and other of said slanting surfaces slanting in another direction relative to the vertical, at least some of the slanting surfaces on each member being angularly turned relative to other of said slanting surfaces on said member, and remotely operable locking means for positively locking the members together to maintain said intermeshing elements locked together.

12. The machine of claim 11, wherein said male member includes a pin for coacting with said grab hook means, aligning means coacting with the aligning means on the female member, intermeshing elements for meshing with the intermeshing elements of said female member, and latch means for coacting with said remotely operable locking means.

13. The machine of claim 12, wherein said intermeshing elements of each member includes rack gear teeth.

14. The machine of claim 13, wherein the grab hook means includes a pair of hook members extending from the base such as to be able to engage and coact with said pin prior to engagement of said aligning means and said rack gear teeth.

15. The machine of claim 13, wherein the aligning means of said members engage to align the members prior to engagement of said rack gear teeth.

16. The machine of claim 14, wherein said aligning means is arranged to be able to engage after engagement of said grab hook members and pin, and before engagement of said rack gear teeth.

17. The machine of claim 12, wherein said grab hook means includes cam means coacting with said pin for aligning the members in end-to-end relation.

18. The machine of claim 17, wherein said aligning means includes means for aligning said members in side-to-side relation.

19. The machine of claim 13, wherein said grab hook means and pin coact with said aligning means to precisely align the members so the rack gear teeth will mesh when the members are in coupled relation.

20. A machine for performing heavy work including, a base member, a boom extending from the base member, a stick mounted on the boom and having a tool on the free end, means on the base for driving the boom and stick, and a quick disconnect coupling between the boom and stick to permit quick interchanging of sticks, said coupling comprising a female member pivotally connected to said boom and a male member rigidly connected to said stick, both said members having intermeshing elements closely interfitting when the members are interconnected, grab hook/aligning means on the female member coacting with pin means on the male member to initially allow the boom to pick up the stick and thereafter to cause longitudinal alignment of said members, said grab hook/aligning means including a pair of oppositely formed spaced elements extending from a base the free ends thereof being spaced closer together than the ends at the base, and cam surfaces extending toward the base for effecting longitudinal alignment of said members so that the intermeshing elements interfit as the pin moves toward the base, the spacing between the free ends of said spaced elements and the length of the pin being such that the elements can engage the pin when the stick extends at an angle thereto, and means for locking the members together.

21. The machine of claim 20, wherein said intermeshing elements include opposing rows of rack gear teeth.

22. In a machine adapted for heavy work including a boom, a stick having a tool for performing heavy work, means for driving the boom and stick, and a quick disconnect coupling between the boom and stick to permit quick interchanging of sticks, the improvement in the coupling which comprises a male member attached to one of the boom of stick and a female member attached to the other of the boom or stick, said female member comprising a base, grab hook means on one end, aligning means intermediate the ends of the base for guiding alignment of the female member, intermeshing elements on said female member adapted to closely interfit with like elements on said male member, said male member including a pin for coacting with said grab hook means, aligning means coacting with the aligning means on the female member, intermeshing elements for meshing with the intermeshing elements of said female member, said intermeshing elements including rack gear teeth which include a plurality of rows of teeth and at least one row extending at an angle to another row, said elements being arranged to inhibit both longitudinal and transverse movement between the male and female members, remotely operable locking means for positively locking the members together to maintain said intermeshing elements locked together, and latch means for coacting with said remotely operable locking means.

23. In a machine adapted for heavy work including a boom, a stick having a tool for performing heavy work, means for driving the boom and stick, and a quick disconnect coupling between the boom and stick to permit quick interchanging of sticks, the improvement in the coupling which comprises a male member attached to one of the boom or stick and a female member attached to the other of the boom or stick, said female member comprising a base, grab hook means on one end, aligning means intermediate the ends of the base for guiding alignment of the female member, intermeshing elements on said female member adapted to closely interfit with like elements on said male member, said male member including a pin for coacting with said grab hook means, aligning means coacting with the aligning means on the female member, intermeshing elements for meshing with the intermeshing elements of said female member, said intermeshing elements including rack gear teeth which include a plurality of rows of teeth and at least one row extending at a right angle to another row, said elements being arranged to inhibit both longitudinal and transverse movement between the male and female members, remotely operable locking means for positively locking the members together to maintain said intermeshing elements locked together, and latch means for coacting with said remotely operable locking means.

24. In a machine adapted for heavy work including a boom, a stick having a tool for performing heavy work, means for driving the boom and stick, and a quick disconnect coupling between the boom and stick to permit quick interchanging of sticks, the improvement in the coupling which comprises a male member attached to one of the boom or stick and a female member attached to the other of the boom or stick, said female member comprising a base, grab hook means on one end, aligning means intermediate the ends of the base for guiding alignment of the female member, intermeshing elements on said female member adapted to closely interfit with like elements on said male member, said male member including a pin for coacting with said grab hook means, aligning means coacting with the aligning means on the female member, intermeshing elements for meshing with the intermeshing elements of said female member, said intermeshing elements including rack gear teeth which include a plurality of rows of teeth and at least one row extending at an angle to another row, said elements being arranged to inhibit both longitudinal and transverse movement between the male and female members, remotely operable locking means for positively locking the members together to maintain said intermeshing elements locked together, latch means for coating with said remotely operable locking means, and said grab hook means including a pair of hook members extending from the base such as to be able to engage and coact with said pin prior to engagement of said aligning means and said rack gear teeth, said hook members including inner portions connected to the base and outer portions extending from the inner portons, said outer portions being closer together than said inner portions so that the hook members can engage the pin in the event the pin extends at an angle to said hook members.

25. The machine of claim 13, wherein said rack gear teeth include a plurality of teeth, at least some of which are disposed at angles relative to other.

* * * * *

UNITED STATES PATENT AND TRADEMARK OFFICE

CERTIFICATE OF CORRECTION

PATENT NO. : 4,938,651

DATED : July 3, 1990

INVENTOR(S) : CHARLES P. GILMORE, JR. and JAMES J. MAYNARD

It is certified that error appears in the above-identified patent and that said Letters Patent is hereby corrected as shown below:

Title page [75] Inventors: Please change the name and address of the first named inventor to --Charles P. Gilmore, Jr., Ash Flat, Arkansas--;

[56] References Cited: please change the number "4,353,945" to --4,355,945--;

Col. 2, line 43, change "pairs" to --pins--;
Col. 8, line 53, change "rock" to --rocking--;
line 66, change "on" to --one--;
Col. 10, line 54, change "of" to --or--; and
Col. 12, line 35, change "other" to --others--.

Signed and Sealed this

Seventh Day of July, 1992

*Attest:*

DOUGLAS B. COMER

*Attesting Officer*

*Acting Commissioner of Patents and Trademarks*